US005339865A

United States Patent [19]

Asghar et al.

[11] Patent Number: 5,339,865

[45] Date of Patent: Aug. 23, 1994

[54] APPARATUS FOR COMPENSATING FOR VARIATIONS IN PRESSURE EXERTED BY A FLUID WITHIN A CONTAINER AGAINST THE CONTAINER

[76] Inventors: Jonathan E. Asghar; Janet A. Asghar, both of 7010 Quill Leaf Cove, Austin, Tex. 78750

[21] Appl. No.: 6,635

[22] Filed: Jan. 21, 1993

[51] Int. Cl.[5] ..... E03B 7/12

[52] U.S. Cl. ..... 138/26; 138/27; 138/28; 220/721

[58] Field of Search ..... 138/26, 27, 28, 30, 138/32; 137/59, 206, 207, 208; 220/720, 721, 723

[56] References Cited

U.S. PATENT DOCUMENTS

| | | | |
|---|---|---|---|
| 85,718 | 1/1869 | Babbitt | 138/27 |
| 596,062 | 12/1997 | Firey . | |
| 1,066,973 | 7/1913 | Anderson | 138/27 |
| 2,283,100 | 5/1942 | Shores | 220/721 |
| 2,409,304 | 10/1946 | Morrison | 138/28 |
| 4,321,908 | 3/1982 | Reed | 126/420 |
| 4,649,959 | 3/1987 | Wadleigh | 138/28 |
| 4,878,597 | 11/1989 | Haast | 220/404 |
| 5,058,627 | 10/1991 | Brannen | 138/27 |

FOREIGN PATENT DOCUMENTS

| | | | |
|---|---|---|---|
| 1075221 | 7/1967 | United Kingdom | 220/721 |

*Primary Examiner*—Timothy F. Simone
*Assistant Examiner*—Patrick F. Brinson
*Attorney, Agent, or Firm*—Foley & Lardner

[57] ABSTRACT

An apparatus for compensating for variations in pressure exerted by a fluid within a container against the container to maintain the pressure below a pressure limit within a predetermined pressure range. The pressure range has an upper range limit above the pressure limit. The apparatus includes an insert member which is substantially non-absorbent with respect to the fluid and which is at least substantially immersed within the fluid. The insert member is compressible over a volumetric range, which volumetric range is established to permit sufficient compression of the insert member to relieve the pressure against the container by a pressure difference. The pressure difference is at least equal to the difference between the upper range limit and the pressure limit. In its preferred embodiment, the insert member is freely floating within the container, though it may be tetheredly attached to a cover or other portion of the container to allow it to freely float within a tethered range of its attachment point. Preferably, the insert member has either a net neutral buoyancy or a net negative buoyancy within the fluid.

4 Claims, 4 Drawing Sheets

APPARATUS FOR COMPENSATING FOR VARIATIONS IN PRESSURE EXERTED BY A FLUID WITHIN A CONTAINER AGAINST THE CONTAINER

BACKGROUND OF THE INVENTION

Compensation for variations exerted by a fluid within a container against the container has been a problem addressed by numerous approaches to its solution in the prior art. Early approaches have provided pressure relief value mechanisms associated with the container which would open in response to pressure in excess of a predetermined pressure and exhaust the fluid from within the container. Environmental considerations have dictated that such pressure relief valves vent to a second container in order to avoid pollution of ambient spaces.

A special case of a fluid exerting increased pressure upon a container is the case of water, which expands when frozen. Several examples of solutions to that dilemma have included U.S. Pat. No. 596,062 to Firey, which provides a hollow rubber core located at the center of a water pipe; U.S. Pat. No. 2,409,304 to Morrison, which provides a compressible core centered inside a water pipe; and U.S. Pat. No. 4,321,908 to Reed, which provides a central compressible core within a water pipe. Prior art approaches to the problem of expanding water (ice) within an enclosure show that much inventive effort has been expended in providing that the compressible core be centrally situated within a pipe.

There is a need for a simple apparatus for compensating for variations in pressure exerted by a fluid within a container against the container which is inexpensive to manufacture, simple to employ within the container, and precludes pollution of ambient atmospheric areas about the container without expensive additional compensating containers, or the like.

SUMMARY OF THE INVENTION

The present invention is an apparatus for compensating for variations in pressure exerted by a fluid within a container against the container, which compensating maintains the pressure below a pressure limit within a predetermined pressure range. The pressure range has an upper range limit above the pressure limit. The apparatus includes an insert member which is substantially non-absorbent with respect to the fluid and which is at least substantially immersed within the fluid. The insert member is compressible over a volumetric range, which volumetric range is established to permit sufficient compression of the insert member to relieve the pressure against the container by a pressure difference. The pressure difference is at least equal to the difference between the upper range limit and the pressure limit. In its preferred embodiment, the insert member is freely contained (i.e. freely deployed) within the container, though it may be tetheredly attached to a cover or other portion of the container to allow it to freely move, or wander within a tethered range of its attachment point. Preferably, the insert member has either a net neutral buoyancy or a net negative buoyancy within the fluid.

It is, therefore, an advantage of the present invention to provide an apparatus for compensating for variations in pressure exerted by a fluid within a container against the container which is inexpensive to manufacture, simple in its deployment within the container, and does not pollute ambient atmospheric areas.

Further objects and features of the present invention will be apparent from the following specification and claims when considered in connection with the accompanying drawings illustrating the preferred embodiment of the invention.

DETAILED DESCRIPTION OF THE INVENTION

Figure 1:
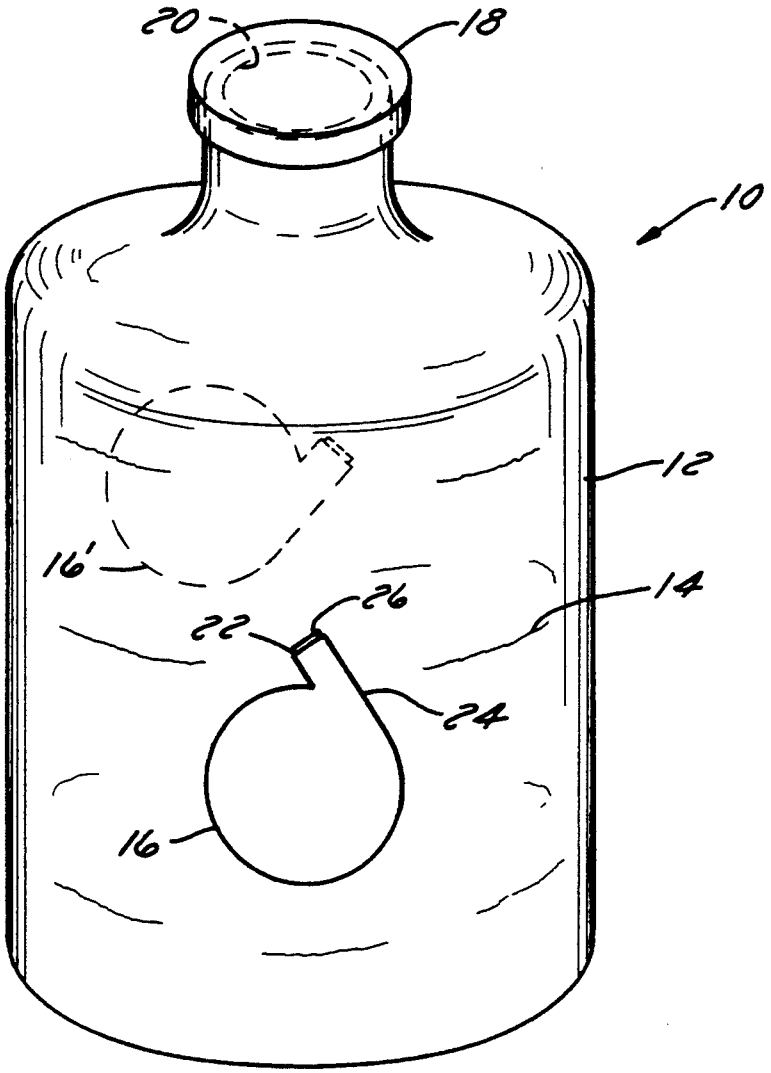
FIG. 1 is a schematic perspective view of the preferred embodiment of the present invention deployed within a fluid contained in a container.

FIG. 1 is a schematic perspective view of the preferred embodiment of the present invention deployed within a fluid contained in a container.

In FIG. 1, an apparatus 10 is contained within a container 12 within which is contained a fluid 14. Apparatus 10 preferably comprises at least one insert member 16, 16' freely deployed within fluid 14 within container 12. Container 12 may include a cover or cap 18 covering an opening 20 through which fluid 14 may be introduced to within container 12. Insert member 16, 16' is preferably compressible and non-absorbent with respect to fluid 14. Insert member 16, 16' may be in any shape, and may comprise a balloon through which air or another compressible fluid is introduced through an opening 22 in a neck 24. Opening 22 is preferably capped by a plug member 26 or otherwise sealedly closeable. Of course, insert member 16, 16' may be permanently sealed closed.

In order to facilitate understanding of the present invention, like elements will be identified by like reference numerals in the various drawings.

Figure 2:
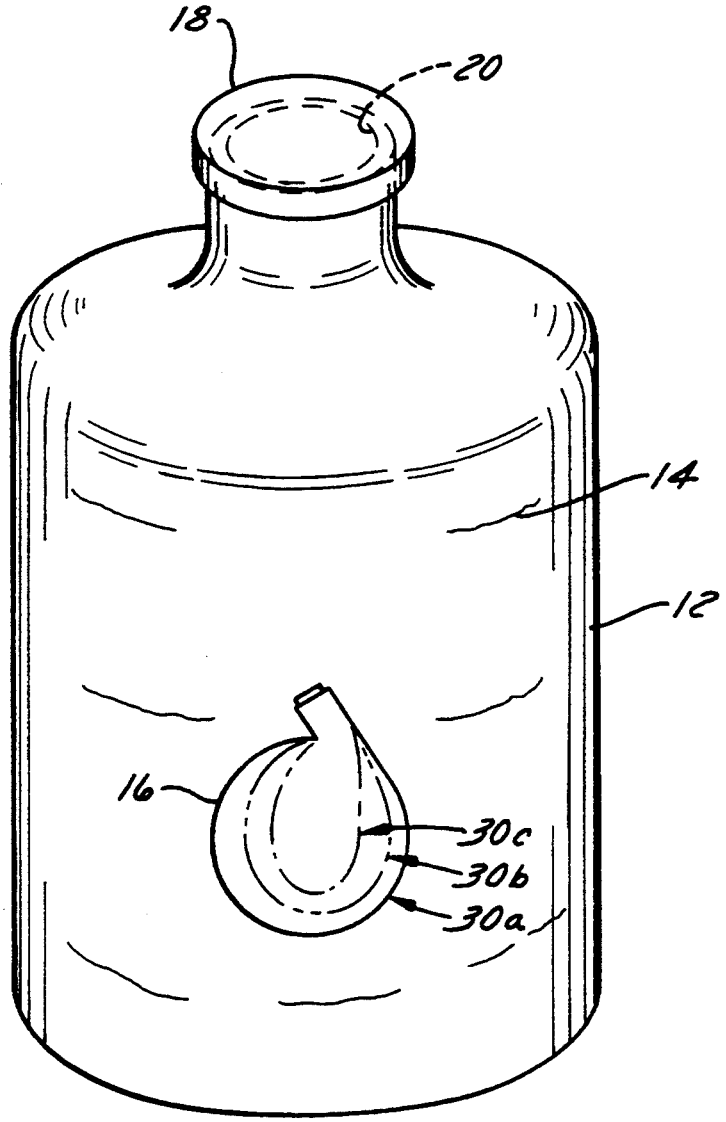
FIG. 2 is a schematic perspective drawing of the present invention deployed within a fluid contained within a container, and illustrating the reaction of the insert member to increased pressure within the container.

FIG. 2 is a schematic perspective drawing of the present invention deployed within a fluid contained within a container, and illustrating the reaction of the insert member to increased pressure within the container.

In FIG. 2, a single insert member 16 is illustrated freely deployed within a fluid 14 contained within a container 12. Illustrated in phantom in FIG. 2 is the characteristic of insert member 16 being compressible over a volumetric range in response to increased pressure of fluid 14 within container 12. That is, at a first pressure, insert member 16 occupies a volume represented by solid line 30*a*. At a second pressure of fluid 14 within container 12, higher than the first pressure, insert member 16 will occupy a volume represented by phantom line 30*b*. At a still higher pressure of fluid 14 within container 12, insert member 16 will occupy a volume represented by phantom line 30*c*.

Figure 3:
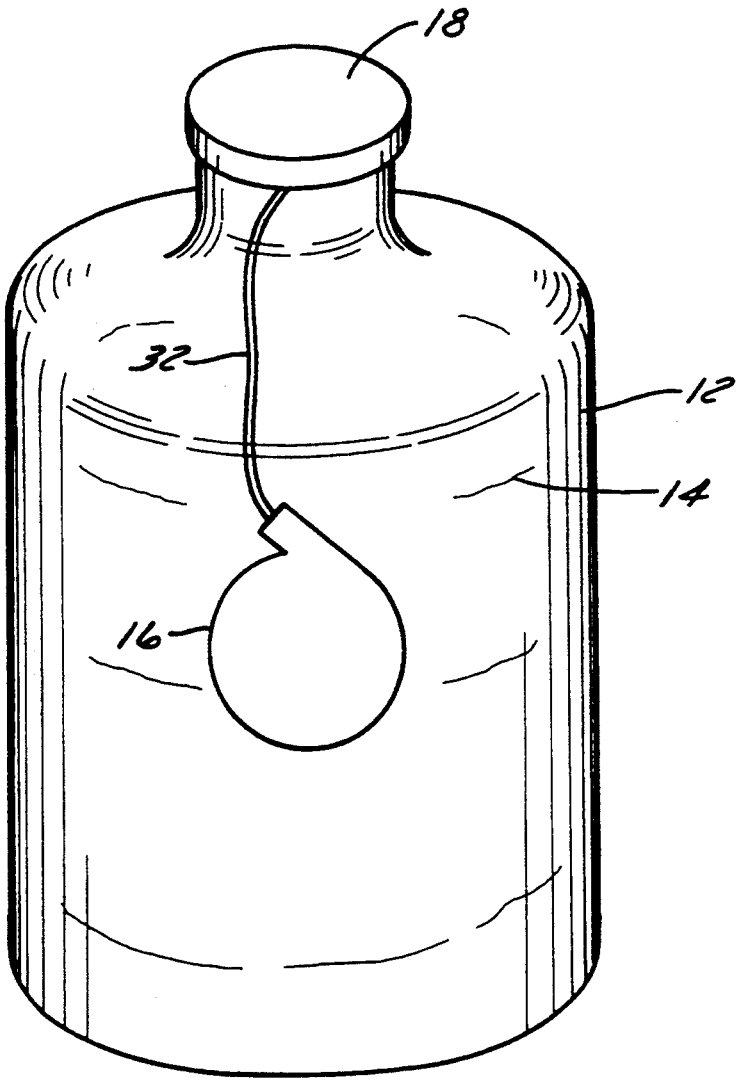
FIG. 3 is a schematic perspective drawing of the preferred embodiment of the present invention tetheredly deployed within a fluid contained within a container.

FIG. 3 is a schematic perspective drawing of the preferred embodiment of the present invention tetheredly deployed within a fluid contained within a container.

In FIG. 3, an insert member 16 is immersed within a fluid 14 inside a container 12. In the alternate embodiment illustrated in FIG. 3, insert member 16 is tetheredly attached with cover 18 via a tether 32. Thus, insert member 16 may freely move, or wander, within fluid 14 inside container 12 to the extent of the range of motion allowed within container 12 by the length of tether 32. Removal of cover 18 with attached tether 32 facilitates removal of insert member 16 from within container 12. The location of insert member 16 within fluid 14 inside container 12 does not affect performance of insert member 16 in its compression over its volumetric range to relieve pressure against container 12 exerted by increased pressure of fluid 14 within container 12. Thus, whether insert member 16 is tetheredly deployed within container 12 or not is of no consequence regarding the effectiveness of insert member 16 in accomplishing its purpose of compensating for variations in pressure exerted by fluid 14 within container 12 against container 12.

Figure 4:
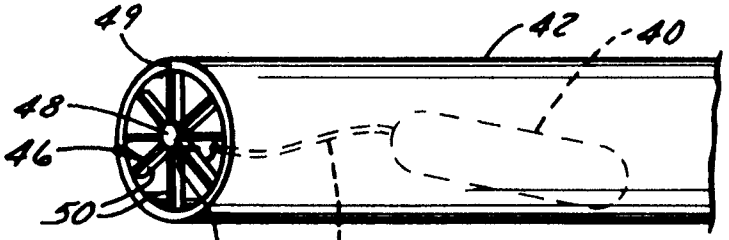
FIG. 4 is a schematic perspective drawing illustrating an alternate embodiment of the present invention tetheredly deployed within a pipe container.

FIG. 4 is a schematic perspective drawing illustrating an alternate embodiment of the present invention tetheredly deployed within a pipe container.

In FIG. 4, an insert member 40 is illustrated situated within a fluid-filled pipe container 42. Insert member 40 may (in the case of FIG. 4, as well as in the case of FIGS. 1–3) be a balloon-type structure or any sealed or sealable structure filled with air or other compressible fluid. Thus, insert member 40 may be any compressible member which is non-absorbent with respect to the fluid (not shown in FIG. 4) contained within pipe container 42. An axially-fixed member 46 is affixed within pipe container 42. Axially-fixed member 46 includes a central hub 48 and, depending from central hub 48, a plurality of spokes 50. Spokes 50 extend to the wall 49 of pipe container 42 and cooperate with wall 49 either by interference fit, by adhesive affixation, by sonic welding, or by other means known in the art to fix axially-fixed member 46 with respect to pipe container 42. A tether attachment 52 which may be in the form of a hook, a loop, or other means of attaching a tether, attaches tether 44 to at least one spoke 50 of axially-fixed member 46, thereby tetheredly deploying insert member 40 with respect to axially-fixed member 46 within pipe container 42.

Figure 5:
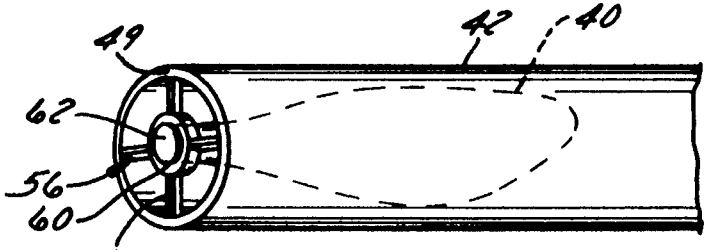
FIG. 5 is a schematic perspective drawing of a second alternate embodiment of the present invention tetheredly deployed within a pipe container.

FIG. 5 is a schematic perspective drawing of a second alternate embodiment of the present invention tetheredly deployed within a pipe container.

In FIG. 5, a fluid-filled pipe container 42 is illustrated containing an insert member 40. Insert member 40 is affixed to an axially-fixed member 56. Axially-fixed member 56 is comprised of a plurality of spokes 58 establishing an interference or other known affixation (as discussed above regarding FIG. 4) of axially-fixed member 56 with respect to wall 49 of pipe container 42. Axially-fixed member 56 contains a central aperture structure 60 at which the various spokes 58 terminate. Central aperture structure 60 captures a sealed end 62 of insert member 40, thereby tetheredly deploying insert member 40 within pipe container 42. Sealed end 62 may be configured to allow temporary opening of sealed end 62 to permit introduction of additional compressible material to the interior of insert member 40 or removal of material from the interior of insert member 40 in order to render the volumetric range over which insert member 40 is compressible an adjustable range.

Figure 6:
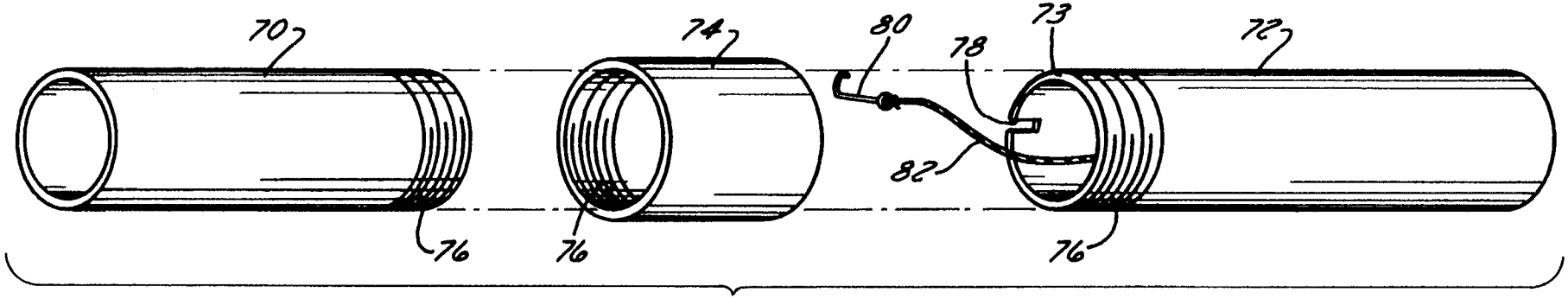
FIG. 6 is an exploded schematic perspective drawing of another alternate embodiment for tethering an insert member within a pipe container.

FIG. 6 is an exploded schematic perspective drawing of another alternate embodiment for tethering an insert member within a pipe container.

In FIG. 6, a first pipe container section 70 and a second pipe container section 72 are illustrated in position for interconnection by a pipe container extension section 74. The schematic illustration of FIG. 6 indicates that such interconnection may be effected by threaded engagement among first pipe container section 70, second pipe container section 72, and pipe container extension section 74 by mated threaded sections 76. The embodiment of the present invention illustrated in FIG. 6 will accommodate other pipe-joining methods, such as adhesive, welding, or the like. Second pipe container section 72 presents a notch 78 in its wall 73. Notch 78 is appropriately dimensioned to nestingly receive a tether attachment 80. Tether attachment 80 is appropriately dimensioned to nestingly reside within notch 78, and be held in such nested residence upon connection of section pipe container section 72 and pipe container extension section 74, while not interfering with such intersection connection. Attached to tether attachment 80 is a tether 82 which tetheredly deploys an insert member (not shown in FIG. 6) within second pipe container section 72. Of course, as one skilled in the art will recognize, the construction of second pipe container section 72 with its notch 78 for accommodating tether attachment 80 may be attachedly engaged with a pipe container extension section 74 having a different configuration than the configuration illustrated in FIG. 6. Thus, pipe container extension section 74 could be an ell section, a faucet assembly, a valve assembly, or another shape or type of assembly which may be attachedly engaged with second pipe container section 72.

It is to be understood that, while the detailed drawings and specific example given describe a preferred embodiment of the invention, they are for the purpose of illustration only, that the apparatus of the invention is not limited to the precise details and conditions disclosed and that various changes may be made therein without departing from the spirit of the invention which is defined by the following claims.

We claim:

1. An apparatus for compensating for variations in pressure exerted by a fluid within a container against said container, said compensating maintaining said pressure below a pressure limit within a predetermined pressure range, said pressure range having an upper range limit above said pressure limit; the apparatus comprising:

an insert member; said insert member being substantially non-absorbent with respect to said fluid and being at least substantially immersed in said fluid; said insert member being compressible over a volumetric range, said volumetric range being established to permit sufficient compression of said insert member to relieve said pressure against said container by a pressure difference, said pressure difference being at least equal to the difference between said upper range limit and said pressure limit; said insert member having a net negative buoyancy.

2. An apparatus for compensating for variations in pressure exerted by a fluid within a container against said container as recited in claim 1 wherein said container includes an opening sealed by a removable cover and wherein said insert member is tetheredly attached to said cover.

3. An apparatus for compensating for variations in pressure exerted by a fluid within a container against said container as recited in claim 1 wherein said insert member is freely contained within said container.

4. An apparatus for compensating for variations in pressure exerted by a fluid within a container against said container as recited in claim 1 wherein said container includes an opening sealed by a removable cover, wherein said insert member is tetheredly attached to said cover, and wherein said insert member is freely tetheredly contained within said container.

* * * * *